US007127806B2

(12) United States Patent
Nelson et al.

(10) Patent No.: US 7,127,806 B2
(45) Date of Patent: Oct. 31, 2006

(54) METHOD FOR MARKING COAXIAL CABLE JUMPER ASSEMBLY INCLUDING PLATED OUTER ASSEMBLY

(75) Inventors: Larry W. Nelson, Hickory, NC (US); Ronald A. Vaccaro, Hickory, NC (US); Bruce W. Cardwell, Newton, NC (US)

(73) Assignee: Commscope Properties, LLC, Sparks, NV (US)

( * ) Notice: Subject to any disclaimer, the term of this patent is extended or adjusted under 35 U.S.C. 154(b) by 236 days.

(21) Appl. No.: 10/734,842

(22) Filed: Dec. 12, 2003

(65) Prior Publication Data

US 2004/0123999 A1 Jul. 1, 2004

Related U.S. Application Data

(62) Division of application No. 10/092,036, filed on Mar. 6, 2002, now Pat. No. 6,667,440.

(51) Int. Cl.
*H01B 13/20* (2006.01)
*H01B 7/34* (2006.01)

(52) U.S. Cl. ..... 29/828; 29/825; 29/840; 174/106 R; 439/320; 228/148

(58) Field of Classification Search ..... 29/825, 29/828, 840, 865, 866–868; 174/35 R, 106 R, 174/107; 439/320, 583, 584–585; 228/148, 228/156
See application file for complete search history.

(56) References Cited

U.S. PATENT DOCUMENTS

| | | | | |
|---|---|---|---|---|
| 283,764 | A | 8/1883 | Delany | |
| 3,340,353 | A | 9/1967 | Mildner | |
| 3,555,169 | A | 1/1971 | Miller et al. | 174/36 |
| 3,612,742 | A | 10/1971 | Snowden | 174/15 |
| 3,685,147 | A | 8/1972 | Nevin et al. | 29/624 |
| 3,761,844 | A | 9/1973 | Reeder | 333/33 |
| 4,169,770 | A | 10/1979 | Cooke et al. | 205/139 |
| 4,484,023 | A | 11/1984 | Gindrup | 174/102 |
| 4,515,992 | A | 5/1985 | Gupta | 174/102 |
| 4,615,115 | A | 10/1986 | Bosshard et al. | 29/860 |
| 4,691,081 | A | 9/1987 | Gupta et al. | 174/105 R |
| 4,785,138 | A | 11/1988 | Breitenbach et al. | 174/106 |
| 4,970,352 | A | 11/1990 | Satoh | 174/106 |
| 5,146,048 | A | 9/1992 | Yutori et al. | 174/36 |
| 5,153,549 | A | 10/1992 | Morinaga | 336/177 |
| 5,232,377 | A | 8/1993 | Leibfried, Jr. | 439/320 |
| 5,262,591 | A | 11/1993 | Aldissi | 174/36 |
| 5,281,167 | A | 1/1994 | Le et al. | 439/578 |
| 5,293,001 | A | 3/1994 | Gebs | |
| 5,307,742 | A | 5/1994 | Jones | 102/202.2 |

(Continued)

*Primary Examiner*—Minh Trinh
(74) *Attorney, Agent, or Firm*—Allen, Dyer, Doppelt, Milbrath & Gilchrist, P.A.

(57) ABSTRACT

A jumper coaxial cable assembly includes a jumper coaxial cable and at least one solder-type connector secured thereto. The cable may include an outer conductor, which, in turn, includes aluminum with a tin layer thereon. The tin layer permits an aluminum outer conductor to be used, yet facilitates soldering of the solder-type connector onto the outer conductor. The tin layer may be a tin alloy, such as a tin/lead alloy, for example. The outer conductor may have a continuous, non-braided, tubular shape, and the tin layer may extend continuously along an entire length of the outer conductor. The tin layer may be readily formed by tin plating during manufacturing of the jumper coaxial cable. The jumper coaxial cable assembly may be joined to a main coaxial cable and/or to electronic equipment.

14 Claims, 4 Drawing Sheets

U.S. PATENT DOCUMENTS 5,357,084 A * 10/1994 McKee et al. ..... 219/605
5,463,188 A 10/1995 Nohmi et al. ..... 174/108
5,515,435 A 5/1996 DeBalko et al. ..... 379/413.03
5,558,538 A 9/1996 Delalle ..... 439/583
5,561,900 A 10/1996 Hosler, Sr. ..... 29/828
5,574,260 A 11/1996 Broomall et al. ..... 174/102
5,665,219 A 9/1997 Yu ..... 205/182
5,802,710 A * 9/1998 Bufanda et al. ..... 29/828
5,959,245 A 9/1999 Moe et al. ..... 174/36
5,965,279 A 10/1999 Yu ..... 428/646
6,154,104 A 11/2000 Hall ..... 333/160
6,201,190 B1 3/2001 Pope ..... 174/102
6,217,380 B1 * 4/2001 Nelson et al. ..... 439/578
6,915,564 B1 * 7/2005 Adams ..... 29/828

* cited by examiner

METHOD FOR MARKING COAXIAL CABLE JUMPER ASSEMBLY INCLUDING PLATED OUTER ASSEMBLY

This application is a divisional of Ser. No. 10/092,036 filed on Mar. 6, 2002 now U.S. Pat. No. 6,667,440, the disclosure of which is hereby incorporated by reference in its entirety.

FIELD OF THE INVENTION

The present invention relates to the field of communications, and, more particularly, to a coaxial cable jumper assembly and related methods.

BACKGROUND OF THE INVENTION

Coaxial cables are widely used to carry high frequency electrical signals. Coaxial cables enjoy a relatively high bandwidth, low signal losses, are mechanically robust, and are relatively low cost. A coaxial cable typically includes an elongate inner conductor, a tubular outer conductor, and dielectric separating the inner and outer conductors. For example, the dielectric may be a plastic foam material. An outer insulating jacket may also be applied to surround the outer conductor.

One particularly advantageous use of coaxial cable is for connecting electronics at a cellular or wireless base station to an antenna mounted at the top of a nearby antenna tower. For example, the transmitter and receiver located in an equipment shelter may be coupled via coaxial cables to antennas carried by the antenna tower. A typical installation includes a relatively large diameter main coaxial cable extending between the equipment shelter and the top of the antenna tower to thereby reduce signal losses. For example, CommScope, Inc. of Hickory, N.C. and the assignee of the present invention offers its CellReach® coaxial cable for such applications.

Each end of the main coaxial cable may be coupled to a smaller diameter, and relatively short, coaxial cable jumper assembly. The coaxial cable jumper assembly includes a length of coaxial cable with connectors attached to the opposing ends. The cable of the jumper cable assembly is typically of a smaller diameter than the main coaxial cable to provide a smaller cross-section, greater flexibility and facilitate routing at the equipment shelter, and also at the top of the antenna tower, for example. Connectors are typically coupled to each end of the jumper coaxial cable to form the coaxial cable jumper assembly.

A coaxial cable is typically manufactured in a continuous fashion wherein an inner conductor or wire and is advanced along a path through an extruder which extrudes a dielectric foam around the inner conductor. Downstream from the extruder are a series of cooling tanks to cool and solidify the dielectric foam. The outer conductor may be applied as a metallic tape formed into a tube around the dielectric layer. The plastic insulating jacket may be extruded downstream from application of the outer conductor.

The connectors for the jumper cable assembly can be installed onto the ends of the coaxial cable at the cable manufacturing plant and/or in the field. Connectors are available in two main categories—mechanical-type connectors which are configured for mechanical installation onto the end of the jumper coaxial cable, and solder-type connectors which are configured to be coupled by soldering. Unfortunately, the mechanical-type connector is relatively complicated, includes many parts, and, therefore, is relatively expensive. Solder-type connectors may be less expensive because of fewer parts. For example, U.S. Pat. No. 5,802,710 to Bufanda et al. discloses a solder-type connector which uses a solder preform wrapped around an annularly corrugated outer conductor of the coaxial cable. The connector body is placed over the solder perform and then heated to solder the connector to the end of the cable.

Unfortunately, not all materials used in connectors and/or coaxial cables are readily suited to soldering. Aluminum is a highly desirable material and is often used for the outer conductor of a jumper coaxial cable. Unfortunately, aluminum does not readily accept solder, and, therefore, more expensive mechanical-type connectors have typically been used in combination with a jumper coaxial cable having an aluminum outer conductor.

SUMMARY OF THE INVENTION

In view of the foregoing background, it is therefore an object of the present invention to provide a coaxial cable jumper assembly that is rugged and readily manufactured, that includes aluminum as the outer conductor material, and which includes at least one solder-type connector.

This and other objects, features, and advantages in accordance with the present invention are provided by a jumper assembly comprising a jumper coaxial cable including an outer conductor, which, in turn, comprises aluminum with a tin layer thereon, and wherein at least one connector is soldered to the tin layer. More particularly, the jumper coaxial cable may be of relatively short length and include an inner conductor, a dielectric layer surrounding the inner conductor, the outer conductor surrounding the dielectric layer, and an outer jacket surrounding the outer conductor. The tin layer may be a tin alloy, such as a tin/lead alloy, for example. Advantageously, the tin layer permits an aluminum conductor to be used, yet facilitates soldering of a solder-type connector onto the outer conductor.

The outer conductor may have a continuous, non-braided, tubular shape. The tin layer may extend continuously along an entire length of the outer conductor, and be on a radially-outer surface of the aluminum layer, for example. The tin layer may be readily formed by plating during manufacturing of the jumper coaxial cable.

The jumper cable assembly may include first and second connectors on opposing first and second ends of the jumper coaxial cable. The jumper coaxial cable may have characteristics to be shape-retaining when formed into a shape having at least one bend therein. This shape-retaining quality may be especially advantageous when routing the jumper assembly to rack-mounted electronic equipment, such as a transmitter or receiver.

The inner conductor may comprise an aluminum rod with a copper layer thereon. The connector may further comprise a connector contact coupled to the inner conductor. The dielectric layer may include plastic, such as a plastic foam, for example. In addition, the jumper coaxial cable may have a diameter in a range of about ⅛ to 2 inches.

Another aspect of the invention relates to a coaxial cable system including a main coaxial cable and a coaxial cable jumper assembly, including the tin-plated outer conductor, and connected to one or both ends of the main cable. The main coaxial cable may have a larger diameter than the coaxial cable of the jumper assembly to thereby reduce signal attenuation. The smaller cable of the jumper assembly may be more flexible and shape retaining which would allow tighter bends required in many routing applications.

Yet another aspect of the invention is directed to a method for making the coaxial cable jumper assembly as described above. The method may include forming a tin layer on an aluminum outer conductor of a jumper coaxial cable comprising an inner conductor and a dielectric layer between the inner and outer conductors; and soldering at least one connector to the tin layer adjacent at least one respective end of the jumper coaxial cable. The tin layer may be a tin alloy, such as a tin/lead alloy, for example, as noted above. The outer conductor may have a continuous, non-braided, tubular shape, and the tin layer may be formed by plating.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
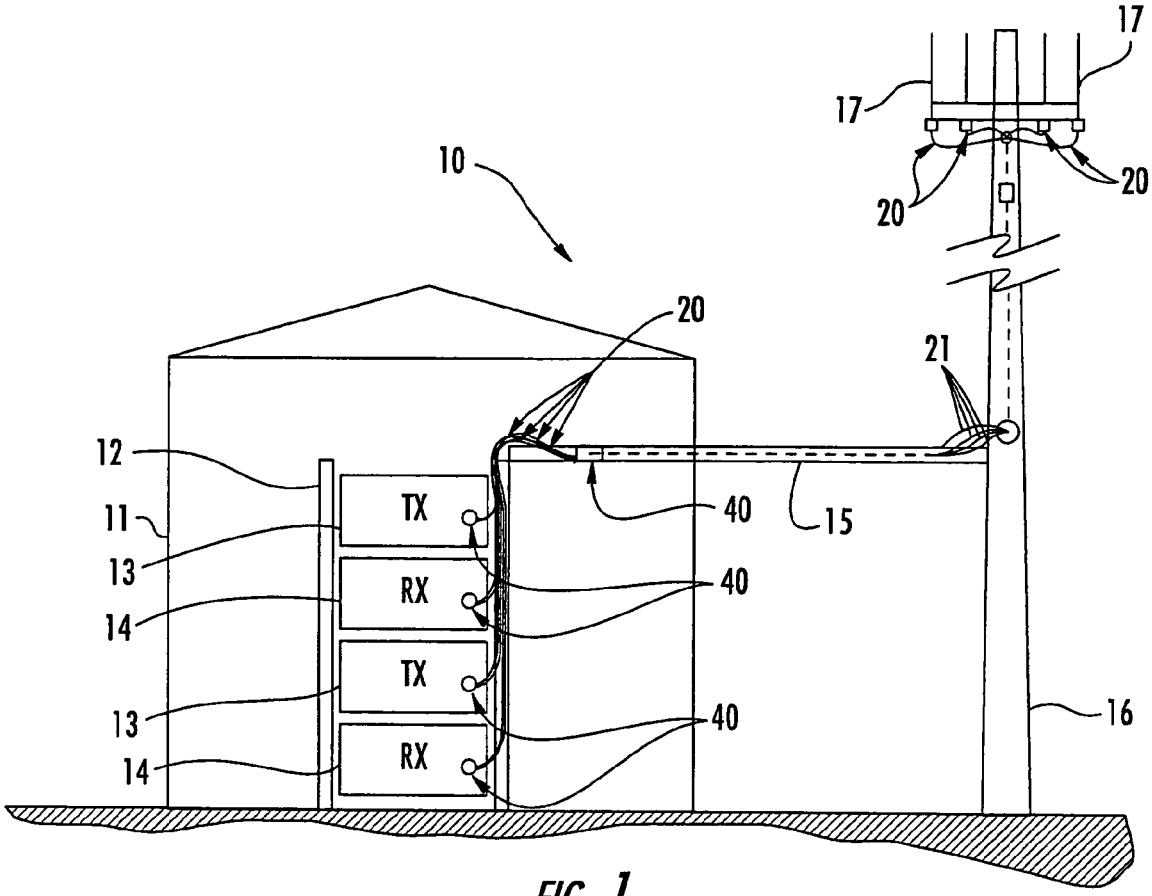
FIG. 1 is a schematic diagram of a cellular base station illustrating a coaxial cable system including the coaxial cable jumper assembly in accordance with the present invention.

Turning initially to FIG. 1, a coaxial cable system in accordance with the present invention is described with reference to use in a cellular or wireless base station 10. The base station 10 illustratively includes an equipment shelter 11 which contains an equipment rack 12 which, in turn, mounts a plurality of transmitters 13 and receivers 14. A cable tray 15 illustratively extends outside of the equipment shelter 11 to a monopole tower 16. The monopole tower 16 mounts a plurality of cellular antennas 17 at its upper end as will be appreciated by those skilled in the art.

As will also be appreciated by those skilled in the art, the coaxial cable system establishes connections between the antennas 17 at the top of the tower 16 and the transmitters 13 and receivers 14 located at the bottom of the tower and within the shelter 11. The coaxial cable system illustratively includes a plurality of coaxial cable jumper assemblies 20 connected to larger main coaxial cables 21 which run from the upper end of the tower 16 into the equipment shelter 11. The main cables 21 may each be a CellReach® model 1873 cable, for example, having a relatively large diameter (about 1 and ⅝ inch) and which typically extend about 90 to 300 feet.

In the illustrated embodiment, jumper assemblies 20 are used at both the upper and lower locations, and the main coaxial cables 21 run within the monopole tower 16. Of course, in other embodiments, only a single jumper assembly 20 may be used, although typically the flexibility of the jumper assembly makes it advantageous to use at both the upper and lower locations.

Figure 2:
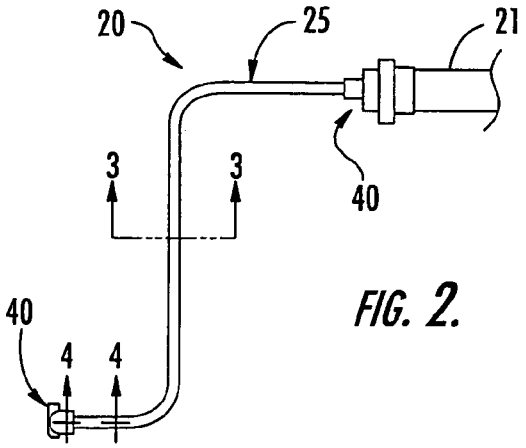
FIG. 2 is a side elevational view of a portion of the coaxial cable system as shown in FIG. 1.
Figure 3:
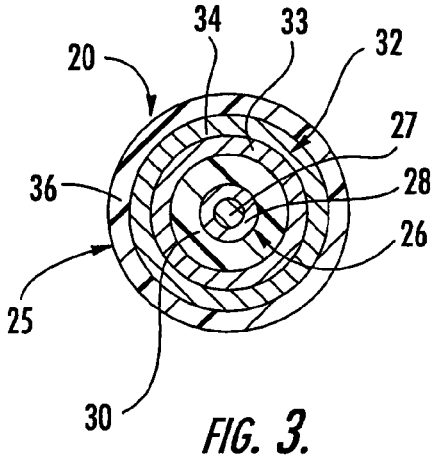
FIG. 3 is a greatly enlarged schematic transverse cross-section view taken along lines 3—3 of FIG. 2.

Turning now additionally to FIGS. 2 and 3, specific features of the jumper cable assembly 20 are now described. This coaxial cable jumper assembly 20 may typically be about 3 to 6 feet long. The jumper assembly 20 illustratively includes a jumper coaxial cable 25 which, in turn, includes an inner conductor 26 provided by an aluminum wire 27 with copper cladding 28 thereon. Other configurations of inner conductors are also contemplated by the present invention.

The inner conductor 26 is surrounded by a foam dielectric layer 30. The dielectric layer 30 is surrounded by an outer conductor 32. The outer conductor 32 is illustratively provided by an aluminum tube 33 with a tin layer 34 thereon. The tin layer 34 advantageously provides a highly compatible surface for soldering. Of course, as used herein "tin layer" is meant to include a pure or substantially pure tin layer, as well as tin alloys, such as tin/lead alloys, for example. In particular, a tin/lead alloy including about 10 percent lead may be used. In other words, the disadvantage of an aluminum outer conductor is overcome by providing a tin layer 34 on the aluminum tube 33 of the outer conductor 32. As will be appreciated by those skilled in the art, aluminum provides a number of desirable other properties including good conductivity, shape-retaining properties, durability, relatively low yield strength, and relatively low cost. External to the outer conductor 32, a jacket or outer protective plastic layer 36 is illustratively provided.

The coaxial cable jumper assembly 20 also illustratively includes solder-type connectors 40 at both ends as perhaps best shown in FIG. 2. Of course, in other embodiments only a single solder-type connector 40 may be provided. In other words, the term "coaxial cable jumper assembly" as used herein is meant to cover embodiments including one or two connectors. For example, a pigtail version of the jumper assembly may include only one solder-type connector installed at the factory. A mechanical-type connector could then be installed in the field, so that the length of the jumper coaxial cable 25 can be precisely measured and cut as will be appreciated by those skilled in the art.

For user convenience, it is envisioned that jumper assemblies 20 with two solder-type connectors 40 will be offered in a number of standard lengths. Accordingly, in these embodiments, the economy and efficiency of two solder-type connectors 40 can be enjoyed.

As mentioned briefly above, the materials and construction of the jumper coaxial cable 25 advantageously provide a shape-retaining property to the cable as perhaps also best understood with reference to FIGS. 1 and 2. In other words, relatively tight bends may be formed by hand, and, moreover, these bends will retain their shape upon release. This advantageous feature may make routing of the jumper assembly 20 considerably easier for the installer.

Figure 4:
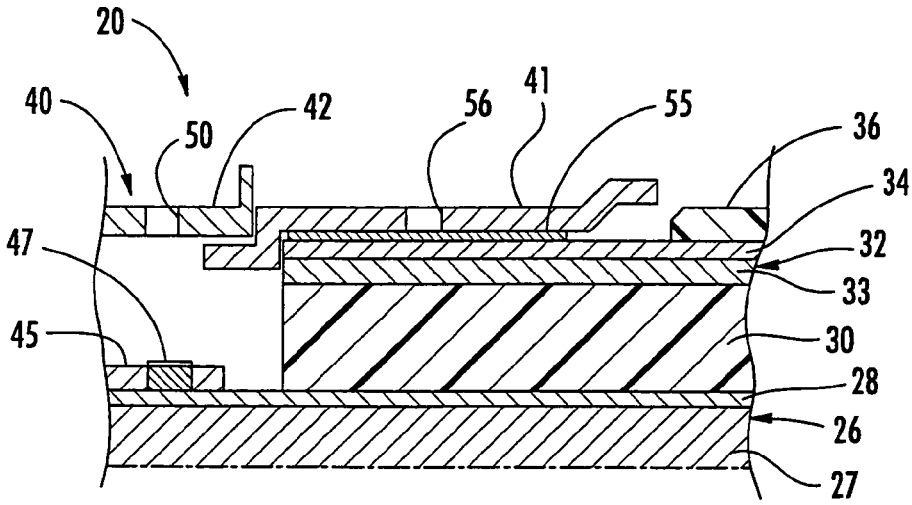
FIG. 4 is a greatly enlarged schematic longitudinal cross-sectional view taken along lines 4—4 of FIG. 2.
Figure 5:
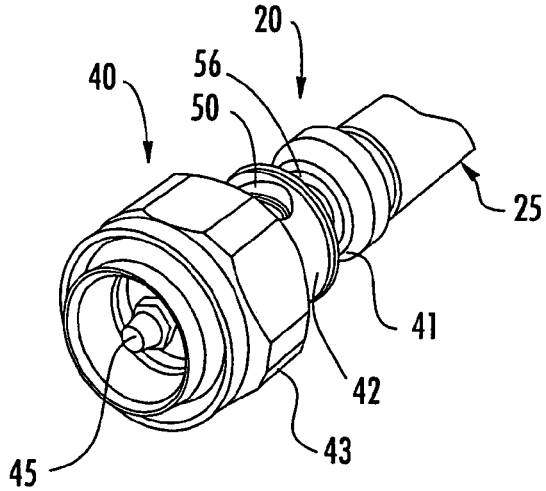
FIGS. 5 and 6 are more detailed perspective and top plan views, respectively, of a solder-type connector as included with the coaxial cable jumper assembly as shown in FIG. 1.
Figure 6:
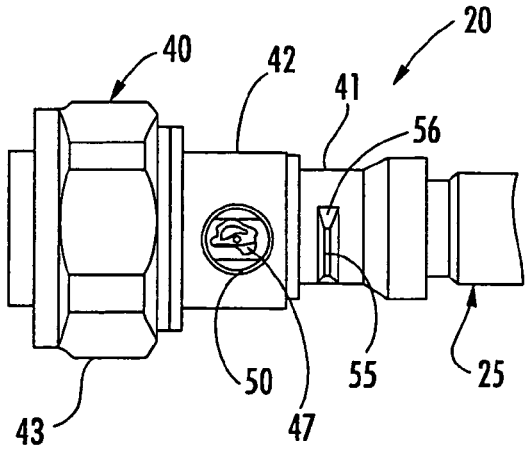

Referring now additionally to FIGS. 4–6, additional details of the solder-type connector 40 and its solder coupling to the jumper coaxial cable 25 are now described. The connector 40 illustratively includes a first tubular body portion 41 which receives the outer conductor 32 of the jumper coaxial cable 25. A second tubular body portion 42 is illustratively connected to the first body portion 41 such as provided by a tight press fit. A rotatable nut portion 43 (FIGS. 5 and 6) is carried by the second body portion 42.

A conductive contact 45 is carried within the second body portion 42 by a dielectric spacer disk, not shown. The conductive contact 45 is illustratively soldered onto the inner conductor 26 by a solder joint 47. This solder joint 47 is accessible through the aligned opening 50 in the second body portion 42.

As can also be seen in the illustrated embodiment, a solder joint 55 is provided between the tin layer 34 of the outer conductor 32 and the first connector body portion 41. It is this solder joint 55 which provides a good electrical connection, as well as a strong mechanical connection between the cable end and connector. This solder joint 55 is also visible/accessible through the slotted opening 56 formed transversely through the wall of the first body portion 41 in the illustrated embodiment.

The solder joint 55 can be readily formed by first positioning a body of solder, or solder preform, between the outer conductor 32 and the adjacent interior portions of the first connector body portion 41. Subsequently applied heat will cause the solder to flow, and, upon cooling, complete the connection as will be readily appreciated by those skilled in the art.

Figure 7:
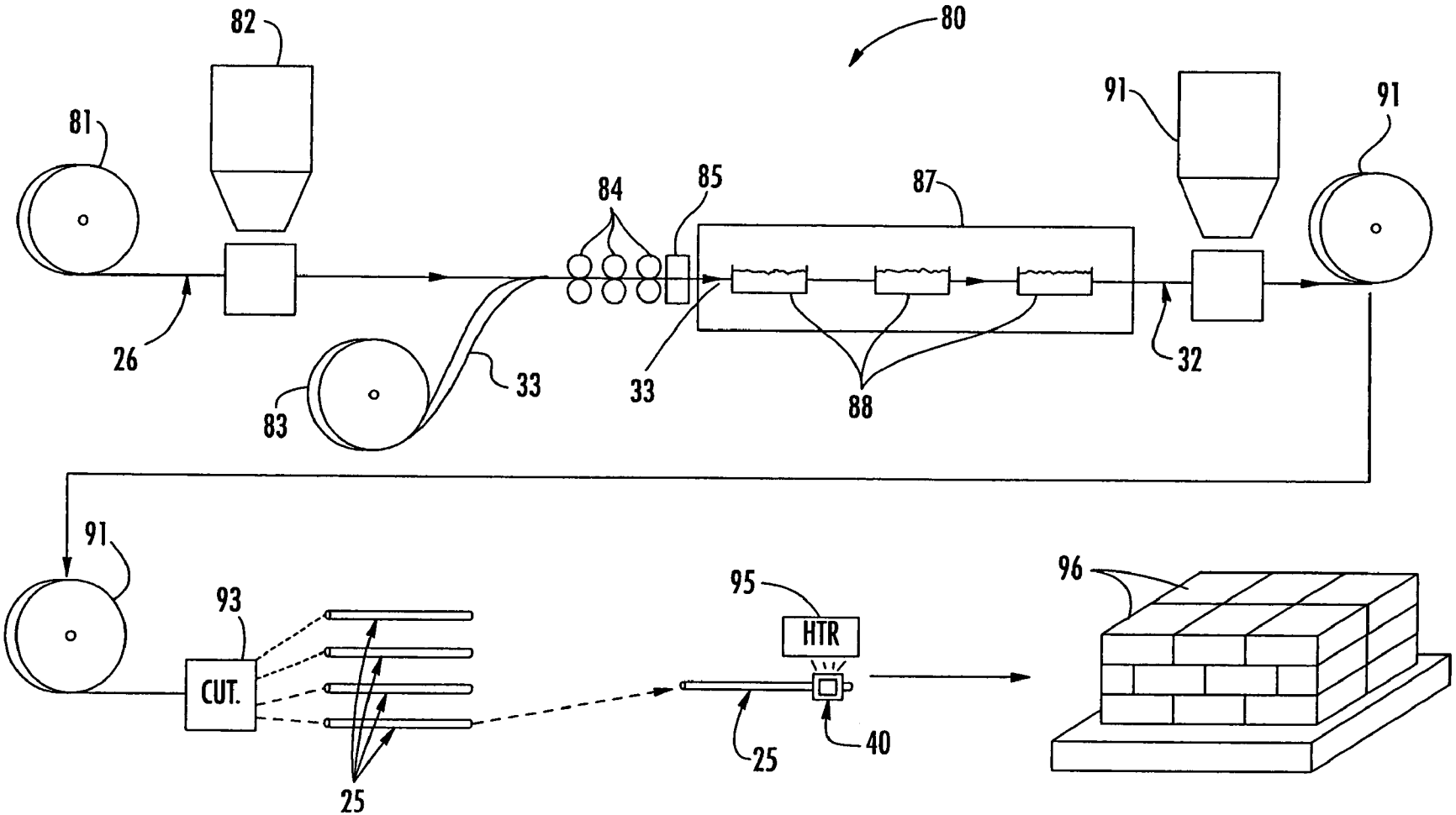
FIG. 7 is a schematic block diagram of an apparatus for making the coaxial cable jumper assembly in accordance with the invention.
Figure 8:
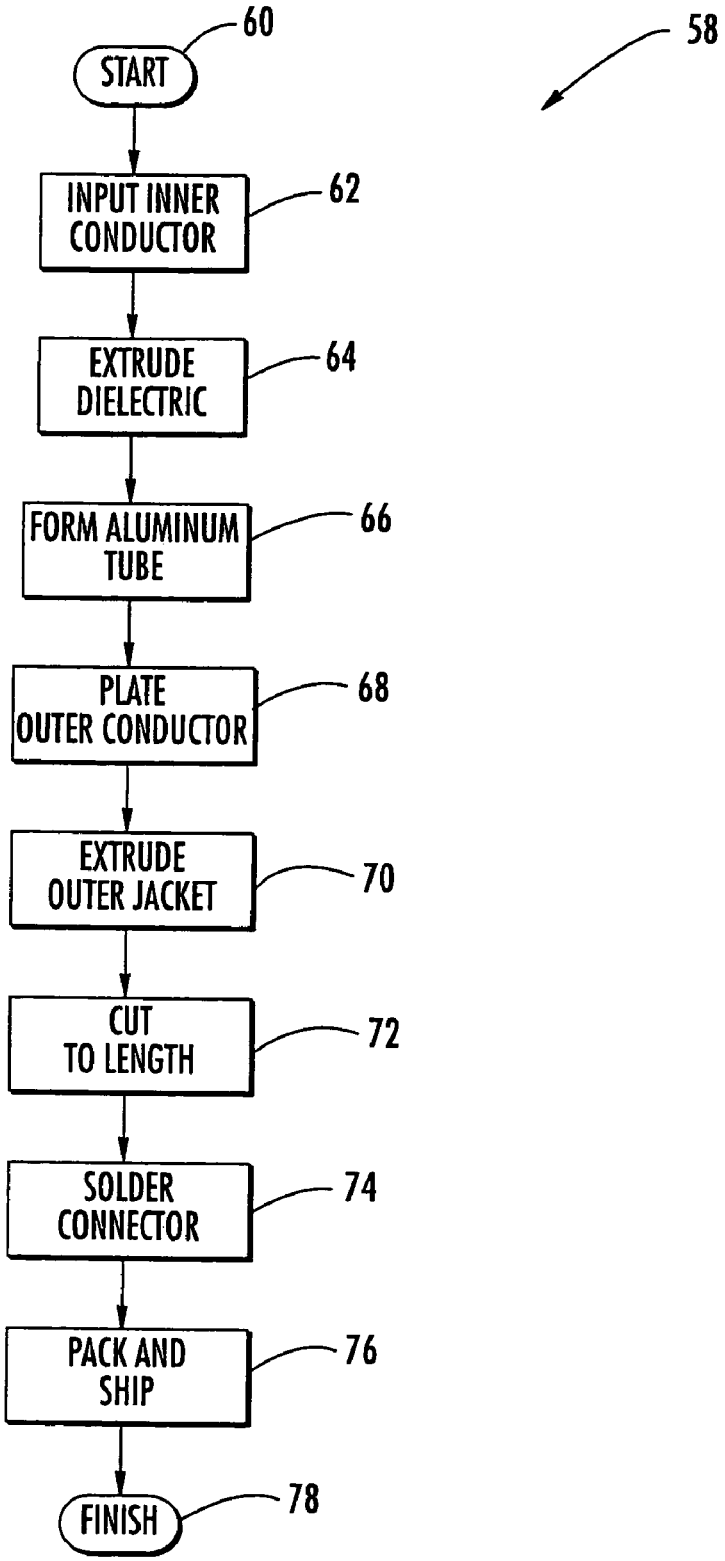
FIG. 8 is a flow chart for the method of making the coaxial cable jumper assembly in accordance with the invention.

Turning now additionally to the schematic manufacturing system 80 of FIG. 7 and the flow chart 58 of FIG. 8, further details of a representative manufacturing operation are now explained. After the start (Block 60), the inner conductor 26 is input from a supply reel 81 to an extruder 82. At Block 64, the extruder 82 extrudes the dielectric layer 30 as will be appreciated by those skilled in the art. Due to the heat of the extruding process, the inner conductor/dielectric layer assembly may pass through a series of cooling tanks, not shown.

A coil of flat aluminum stock is illustratively fed from a supply reel 83 through a series of forming rollers 84 to shape the stock into a tube. The tube may be continuously butt welded downstream from the rollers 84 at the schematically illustrated welding station 85 to form the aluminum tube 33 (Block 66). Thereafter, at Block 68, the aluminum tube 33 is plated with tin at a plating station 87. The plating station 87 illustratively includes a series of chemical plating/treatment baths 88 as will be readily appreciated by those of skill in the art. For example, cleaning and rinsing tanks may be provided in some embodiments, in addition to the plating tank. Other configurations are also contemplated by the present invention. The plating bath may rely on well-known electrochemical plating chemistry as will be readily appreciated by those skilled in the art without requiring further discussion herein.

The partially completed cable then illustratively passes through a final extruder 90 which extrudes the outer jacket 36 at Block 70. The jumper coaxial cable 25 is then taken up and stored on a supply reel 91 for use in subsequent assembly steps. More particularly, as shown in the lower portion of FIG. 7, the jumper coaxial cable 25 from the supply reel 91 may be cut to length at a cutting station or table 93 (Block 72). At Block 74, downstream from the cutting station 93, the solder-on connector 40 is assembled onto the prepared end of the jumper coaxial cable 25, and heat applied by the schematically illustrated induction heater 95. Accordingly, the solder preform positioned between the outer conductor 32 and adjacent portions of the connector 40 is melted and flows to join these adjacent portions together as will be readily understood by those skilled in the art.

The solder may comprise conventional tin/lead alloys, or other low melting temperature materials as will be appreciated by those skilled in the art. The surfaces may also be additionally prepared using flux as will also be appreciated by those skilled in the art. In yet other embodiments, soldering may be performed by injecting melted solder between adjacent portions of the connector and the outer conductor as will be appreciated by those skilled in the art.

Of course, if two connectors 40 are desired, the connector assembly and heating operations are repeated. Downstream from the inductive heater 95, final inspection may be performed, before the jumper cable assembly 20 is packaged into containers 96 for shipping at Block 76 before stopping at Block 78.

As described above, in some embodiments, it may be preferred to plate the tin onto the aluminum tube; however, in other embodiments of the invention, the flat stock provided for forming the outer conductor, may already be tin-plated. In addition, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

What is claimed is:

1. A method for making a coaxial cable jumper assembly comprising:

forming a jumper coaxial cable comprising an inner conductor, a dielectric layer surrounding said inner conductor, an outer conductor surrounding said dielectric layer, said outer conductor including an aluminum layer and a tin layer thereon;

soldering at least one connector to the tin layer adjacent at least one respective end of the jumper coaxial cable.

2. A method according to claim 1 wherein forming the tin layer comprises forming a tin alloy layer.

3. A method according to claim 2 wherein forming the tin alloy layer comprises forming a tin/lead alloy layer.

4. A method according to claim 1 wherein the outer conductor has a continuous, non-braided, tubular shape.

5. A method according to claim 1 wherein forming the tin layer comprises plating the tin layer.

6. A method according to claim 5 wherein plating the tin layer comprises plating the tin layer to extend continuously along an entire length of the outer conductor.

7. A method according to claim 5 wherein plating is performed in a plating bath.

8. A method according to claim 5 wherein plating the tin layer comprises plating the tin layer on a radially-outer surface of the aluminum layer.

9. A method according to claim 1 further comprising cutting the jumper coaxial cable to a desired length before soldering.

10. A method according to claim 1 further comprising forming a jacket surrounding the outer conductor and stripping back a portion thereof prior to soldering.

11. A method according to claim 1 wherein soldering comprises positioning a body of solder between the at least one connector and the outer conductor, and thereafter heating the body of solder to flow and join the at least one connector and outer conductor together.

12. A method according to claim 11 wherein the heating is performed by induction heating.

13. A method according to claim 1 wherein soldering comprises injecting melted solder between the at least one connector and the outer conductor to join the at least one connector and outer conductor together.

14. A method according to claim 1 wherein soldering the at least one connector comprises soldering first and second connectors on respective first and second ends of the jumper coaxial cable.

* * * * *